US005308514A

United States Patent [19]

Olson et al.

[11] Patent Number: 5,308,514

[45] Date of Patent: May 3, 1994

[54] SULFONATE GREASES

[75] Inventors: William D. Olson, Scarborough; Ronald J. Muir; Theo I. Eliades, both of West Hill, all of Canada; Thomas Steib, Pittsburgh, Pa.

[73] Assignee: Witco Corporation, New York, N.Y.

[21] Appl. No.: 25,598

[22] Filed: Mar. 3, 1993

[51] Int. Cl.[5] ..... C10M 125/22

[52] U.S. Cl. ..... 252/18; 252/332

[58] Field of Search ..... 252/18, 33.2

[56] References Cited

U.S. PATENT DOCUMENTS 4,560,489 12/1985 Muir et al. ..... 252/18

*Primary Examiner*—John Niebling
*Assistant Examiner*—Eana Wong
*Attorney, Agent, or Firm*—Lockwood, Alex, FitzGibbon & Cummings

[57] ABSTRACT

High performance overbased calcium sulfonate greases comprising up to about 28% by weight overbased calcium sulfonate, solid particles of colloidally dispersed calcium carbonate essentially in the form of calcite, a calcium soap of a fatty acid of twelve to twenty-four carbon atoms, and oleaginous vehicle wherein at a concentration of about 28% by weight overbased calcium sulfonate said greases have a worked cone penetration rating of less than about 295.

14 Claims, No Drawings

SULFONATE GREASES

This invention relates to high performance overbased calcium sulfonate greases, the preparation of these greases and intermediates. More particularly, this invention relates to high performance overbased calcium sulfonate greases comprising up to about 28% by weight overbased calcium sulfonate, solid particles of colloidally dispersed calcium carbonate essentially in the form of calcite, a calcium soap of a fatty acid of twelve to twenty-four carbon atoms, in an oleaginous vehicle wherein at a concentration of about 28 percent by weight overbased calcium sulfonate said greases have a worked cone penetration rating less than about 295.

As pointed out in commonly assigned U.S. Pat. No. 4,560,489 of Muir at column 1, lines 28 to 46, thixotropic greases or grease like overbased calcium sulfonate compositions have corrosion-inhibiting properties and have utility for a variety of uses such as, for instance, in automobile and truck body undercoating, and for various other purposes known to the art and are disclosed in various publications and patents, such as U.S. Pat. Nos. 3,242,079; 3,372,115; 3,376,222; 3,377,283; 3,523,898; 3,661,622; 3,671,012; 3,746,643; 3,730,895; 3,816,310; and 3,492,231. Such greases or grease-like compositions have gone into wide spread use either as such, or mixed with other ingredients to produce compositions for use in a variety of environments and generally speaking they are characterized by reasonably good E.P. & Antiwear Properties, high dropping points, reasonably good resistance to mechanical breakdown, salt spray and water-corrosion resistance, thermal stability at high temperatures, and other desirable properties.

As is well known greases are sold in various grades depending upon the softness of the grease. The softer the grease the more fluid the grease. Typically these greases are rated or graded on the basis of their worked cone penetration range. For example, greases sold under the designation grade zero have a cone penetration number from about 355 to 385, those having a needle penetration range of 310 to 340 are designated grade one and the most widely sold greases have a cone penetration range of 265 to 295 and are designated grade two. The lower the grade of the grease the more relatively inexpensive oleaginous vehicle and the cheaper the grease.

For the purposes of this invention cone penetration is measured by the ASTM cone penetration test (D217). Penetration is the depth, in tenths of millimeters, to which a standard cone sinks into the grease under prescribed conditions. Thus higher penetration numbers indicate softer greases, since the cone has sunk deeper into the sample.

While the greases described in U.S. Pat. No. 4,560,489 have excellent properties and routinely have worked pen numbers of 265 to 295, the particularly preferred greases contain about 40 to 45% by weight overbased calcium sulfonate (See column 7, lines 54–61). At column 12, lines 52 et seq., the patentees point out that if the content of overbased calcium sulfonate is in the range of 38% by weight or less, a relatively soft grease is obtained which, generally is not optimum i.e. the grease does not satisfy requirements for grade two. A firmer grease is obtained at 41 to 45% by weight overbased calcium sulfonate. Since overbased calcium sulfonate is the most expensive component of these greases it is desirable to reduce the overbased calcium sulfonate content and replace same with relatively inexpensive oleaginous media without lowering the grease grade.

The greases disclosed in U.S. Pat. No. 4,560,489 can be prepared by one step or two step processes. In the one step process, neutral calcium sulfonate, hydrated lime, lubricating oil, a converting agent capable of converting amorphous calcium carbonate into crystalline calcium carbonate, a catalyst suitable for promoting carbonation of the neutral calcium sulfonate, such as methanol, are carbonated to form a non-Newtonian highly overbased calcium sulfonate solution. Additional oil stock, lime, water, boric acid and fatty acid are then added to complete the production of the overbased calcium sulfonate grease. In the two step process, a composition comprising a Newtonian highly overbased calcium sulfonate solution is first converted to a thickened intermediate non-Newtonian product by initial treatment thereof with a converting agent such as acetic acid, propionic acid or an alcohol. Then, there is subsequently added thereto, at elevated temperatures, boric acid admixture with or dissolved or partially dissolved in hot water, lime or calcium hydroxide and the soap-forming aliphatic monocarboxylic or fatty acid such as a $C_{12}$ to $C_{24}$ acid. In both the one step and two step processes, the soap-forming aliphatic monocarboxylic acid or fatty acid containing from 12 to 24 carbon atoms is added to the non-Newtonian highly overbased calcium sulfonate solution containing calcium carbonate in the calcite form.

While Muir discloses at column 8, lines 17 to 29 that in the preparation of overbased sulfonate, free lime or calcium hydroxide on the order of about 1% to about 1.5% may be present, there is no teaching that the use of excess lime can be advantageous.

The general object of this invention is to provide high performance overbased calcium sulfonate greases having a relatively low concentration of overbased calcium sulfonate for each grade level of the grease.

Another object of this invention is to provide a method of producing overbased calcium sulfonate greases having a relatively low concentration of overbased calcium sulfonate.

In one aspect this invention is high performance overbased calcium sulfonate greases comprising up to about 28% by weight overbased calcium sulfonate, solid particles of colloidally dispersed calcium carbonate essentially in the form of calcite, a calcium soap of a fatty acid of twelve to twenty-four carbon atoms, in an oleaginous vehicle wherein at a concentration of about 28 percent by weight overbased calcium sulfonate said greases have a worked cone penetration rating less than about 295.

In a second aspect this invention comprises forming an overbased calcium sulfonate grease comprising an overbased calcium sulfonate, colloidally dispersed calcium carbonate in the form of crystalline solids of calcite which comprises the steps of (1) heating a composition comprising overbased calcium sulfonate, amorphous calcium carbonate, an oleaginous vehicle and a converting agent comprising a fatty acid of 12 to 24 carbon atoms and (2) treating said composition with components comprising a fatty acid of 12 to 24 carbon atoms.

The general object of this invention can be attained by a process of forming an overbased calcium sulfonate grease comprising an overbased calcium sulfonate, colloidally dispersed calcium carbonate in the form of calcite which comprises the steps of (1) heating a composition comprising overbased calcium sulfonate, amorphous calcium carbonate, an oleaginous vehicle and either (a) converting agent comprising a fatty acid of 12 to 24 carbon atoms or (b) mixture of converting agent and excess lime preferably under pressure and (2) treating said composition with components comprising fatty acid of 12 to 24 carbon atoms and an inorganic acid or organic acid of up to 7 carbon atoms. Surprisingly, we have found that by carrying out the conversion of calcium carbonate to calcite employing a fatty acid of 12 to 24 carbon atoms as at least a portion of the converting agent or by employing a converting agent and excess lime and post adding fatty acid of 12 to 24 carbon atoms to the conversion product, it is possible to produce grade two greases (worked cone penetration of less than 295) containing about 23% by weight starting overbased calcium sulfonate with the preferred inorganic acid, boric acid. As indicated above U.S. Pat. No. 4,560,489 generally requires about 40 to 45 weight percent overbased calcium sulfonate to produce a grade two grease. If all of the fatty acid is employed in the conversion step (1) without excess lime but employing pressure, grade 2 greases can be produced containing about 32% by weight starting overbased calcium sulfonate and (2) employing pressure, vaterite calcium carbonate crystals are formed with the calcite. Vaterite crystals should be avoided. On the one hand the calcite crystal form produces non Newtonian Rheology, enhances yield and adds to high temperature properties of the grease while the vaterite form is not preferred because it does not enhance high temperature greases properties.

While grade 2 greases can be prepared by the process of this invention containing up to 28% by weight overbased calcium sulfonate using either excess lime or fatty acid in the conversion step, it is preferred to use the fatty acid technique since these grade 2 greases have better pumping properties and contain at least 75% by weight oil and typically at least 80% by weight oil.

Briefly the greases of this invention can be formed by heating overbased calcium sulfonate, amorphous calcium carbonate and (a) converting agent comprising a fatty acid of 12 to 24 carbon atoms or (b) converting agent and excess lime in an oleaginous media to convert the amorphous calcium carbonate to calcite crystals and adding fatty acid of 12 to 24 carbon atom thereto and an inorganic acid or organic and of 1 to 7 carbon atoms and forming calcium salts and calcium soaps of fatty acid in situ.

Suitable sulfonic acids useful in the production of the calcium sulfonates are oil-soluble and can be produced by sulfonating a feedstock which is most commonly a linear or branched chain alkyl benzene such as a mixture of mono-and di-alkyl benzenes in which the alkyl radical contains largely from 12 to 40 carbon atoms, generally mixtures of such alkyl radicals. The sulfonic acids are generally produced in solution in a volatile inert organic solvent such as Varsol or naphtha or mineral spirits and are conventionally converted to calcium sulfonates by reaction with calcium hydroxide. In the practice of our present invention, as indicated above, it is particularly advantageous to utilize alkyl benzene sulfonic acids containing from 12 to 40 carbon atoms or mixtures containing primarily 12 to 40 carbon atoms as the alkyl radical(s). However, in the broader aspects of our invention, generally equivalent oil-soluble sulfonic acids can be used, such as are shown, for instance, in U.S. Pat. Nos. 3,242,079; 3,671,012; and others of the patents referred to above.

The overbased calcium sulfonates useful in this invention can be prepared by any of the techniques employed in this art. Typically, these materials can be prepared by heating neutral calcium sulfonate or sulfonic acid, oleaginous vehicle, hydrated lime and a carbonation promoter, such as methanol, to the carbonation temperature and adding sufficient carbon dioxide to produce an overbased sulfonate having the desired TBN. For purposes of this invention, the overbased calcium sulfonate can have a metal ratio of about 6 to 35.

Soap forming aliphatic or fatty acids of 12 to 24 carbon atoms include dodecanoic acid, palmitic acid, stearic acid, oleic acid, ricinoleic acid, 12-hydroxystearic acid. The hydroxy fatty acids, particularly hydroxystearic acid, are preferred since they provide greater thickening to the greases than the unsubstituted fatty acids.

Suitable salt (complex forming acids) forming acids include mineral acids such as sulfonic acid, hydrochloric acid, orthophosphoric acis, pyrophosphoric acid, sulfurous acid, etc.; organic acids of 1 to 7 carbon atoms include formic acid, acetic acid, propionic acid, valeric acid, oxalic acid, malonic acid, succinic acid, benzene sulfonic acid, etc. Of these, boric acid and boric acid formers are preferred since they provide the best grease properties.

Converting agents useful in this invention include, among many others, water; alcohols, for instance, methanol, isopropyl alcohol isobutanol, n-pentanol and many others or mixtures thereof or mixtures of alcohols with water; alkylene glycols; mono-lower alkyl ethers of alkylene glycols such as monomethylether of ethylene glycol (methyl Cellosolve); and numerous others such as lower aliphatic carboxylic acids exemplified by acetic acid and propionic acid; ketones; aldehydes; amines; phosphorus acids; alkyl and aromatic amines; certain imidazoilines; alkanolamines; boron acids, including boric acid; tetraboric acid; metaboric acid; and esters of such boron acids; and, also, carbon dioxide as such, or better in combination with water.

In those cases, where excess lime is not used in the conversion step, from 20 to 90%, preferably 40 to 75% by weight of the soap forming $C_{12}$ to $C_{24}$ fatty acid can be employed in the converting step with the remainder added to the converted grease. As indicated above, other things being equal, if all of the soap forming fatty acid is used in the converting step, grade 2 greases can be produced containing about 32% by weight overbased calcium sulfonate. Other things being equal, splitting the fatty acid permits the production of grade 2 greases containing 15 to 28% overbased calcium sulfonate. Accordingly, if all the fatty acid is used in the conversion step more overbased calcium sulfonate is necessary to produce a grade 2 grease.

When excess lime is used in the conversion step, it is possible to reduce the concentration of overbased calcium sulfonate by about 3.3% by weight (e.g. 42% by weight to 38.7% by weight) for each 1% by weight excess lime or calcium hydroxide used in the step of converting amorphous calcium carbonate to calcite.

As indicated above, the high performance overbased calcium sulfonate/calcium carbonate complex greases of our invention comprise calcium carbonate in the calcite form, oleaginous vehicle, minor proportions, by weight, of (a) a mineral or short chain 1 to 7 carbon atom calcium salt preferably calcium borate and (b) a calcium soap of a soap-forming aliphatic monocarboxylic acid containing at least 12 carbon atoms, said (a) and (b) ingredients being essentially homogeneously distributed through said complex grease, and in which the preferred embodiments utilize as the calcium soap the calcium soaps of hydroxy $C_{12}$–$C_{24}$ fatty acids, particularly 12-hydroxystearic acid, and in which the (a) ingredient is particularly advantageously formed in situ in said greases and preferably at least a portion of the (b) component is used as a converting agent in the conversion of amorphous calcium carbonate to crystalline calcium carbonate in the form of calcite and a portion of the (b) component is formed in situ after the conversion of amorphous calcium carbonate to calcite. Somewhat less preferred are the products formed using excess lime in the calcite forming step and all the (b) component formed in situ after the conversion of amorphous calcium carbonate to calcite.

The overbased calcium sulfonate content of said greases, as produced by the processes described above and which are shown by the illustrative particular Examples which are set out below, will generally fall within the weight range of about 10 to 28%. The non-volatile oil, particularly a mineral or lubricating oil, content of the greases generally fall within the range of about 60 to about 90%, said proportions of said non-volatile oil constituting the total oil, that is, the added non-volatile oil plus that present in the overbased calcium sulfonate composition. The boron acid or boric acid component, in the preferred greases of our invention, generally fall within the range of about 0.6 to about 3.5% with a particularly preferred range of about 1.2 to about 3%. The content of the soap-forming, aliphatic monocarboxylic acid, such as 12-hydroxystearic acid, used in the production of the calcium soap or soaps of the soap-forming aliphatic monocarboxylic acids or hydroxy-fatty acids containing at least 12 and up to about 24 carbon atoms, desirably $C_{12}$ to $C_{18}$ hydroxy-fatty acids, such as commercial hydroxystearic acid, generally fall within the range of about 1 to about 6%, with a particularly preferred range of about 1.3 to about 5%. The added lime or calcium hydroxide, the acid components to react with (boric acid and the soap-forming aliphatic monocarboxylic acids), is, by weight of the greases, in the range of about 0.5% to about 5%. However, in certain cases, in the preparation of the overbased calcium sulfonate composition or solutions, there is commonly present in said compositions or solutions, after the carbonation step, or after the conversion of amorphous sodium carbonate to calcite free dispersed lime or calcium hydroxide in an amount of the order of about 1% to 8% (about 1% to about 1.5% in the case of excess lime after the carbonation step or 2% to 10% after the conversion step using excess lime), which may render it unnecessary to add any additional calcium oxide or hydrated lime to form the preferred calcium borate and the calcium soaps of the soap-forming aliphatic monocarboxylic acids, in which event the range of the lime or calcium hydroxide is, by weight of the greases, from 0% to about 8%. The content of calcium borate or its complex reaction mixture in the preferred grease compositions of the present invention is generally in the range of about 1.1% to about 6.7%; and that of the calcium soaps of the aliphatic monocarboxylic or fatty acids in the range of about 1.1% to about 6.5%. The relationship of the proportions of the boric acid, the lime or calcium hydroxide and the soap-forming aliphatic monocarboxylic acids utilized in the production of the preferred greases of our present invention play a definite role in the production of optimum quality or effective greases, as illustrated hereafter. All of the foregoing percentages are in terms of wt. %, based on the weight of the greases as they are produced in accordance with the process or processes of our invention.

Various supplemental ingredients are commonly, incorporated into the greases of our invention, in very distinctly minor proportions but they are not essential to our invention and no patentable novelty is claimed in their use in those instances where they are included in our greases. Illustrative of such supplemental ingredients are oxidation inhibitors such as phenyl alpha naphthylamine (PAN); viscosity index improvers, which may comprise certain polymers (Acryloid 155-C); and others for particular and generally known properties in greases or grease compositions.

The grease compositions of this invention can be prepared by either a one step or two step process in a manner similar to that described in U.S. Pat. No. 4,560,489, which is hereby incorporated by reference.

The preferred two step process comprises heating a Newtonian composition comprising overbased calcium sulfonate, amorphous calcium carbonate, an oleaginous vehicle and a converting agent comprising a fatty acid of 12 to 24 carbon atoms under condition favoring the formation of calcium carbonate crystals in the form of calcite crystals and not vaterite crystals. Vaterite crystals should be avoided. On the one hand the calcite crystal form introduces non Newtonian Rheology, enhances yield and adds to the high temperature properties of the grease while the vaterite form is much less thixotropic and does not enhance high temperature grease properties. Accordingly the conversion is carried out at about 100° to 300° F., preferably 145° to 285° F. and up to 85 psi or higher, preferably under autogenous pressure. Then, there is subsequently added thereto, at elevated temperatures, a boric acid compound admixed with or dissolved or partially dissolved in hot water, lime or calcium hydroxide, and additional soap-forming aliphatic monocarboxylic or fatty acid, such as a $C_{12}$–$C_{24}$ hydroxy fatty acid, not used in the conversion step to convert the boric acid to a calcium borate and to convert the aforesaid soap-forming acid or acids to calcium soaps, with or without supplemental ingredients which are optional and do not form any part of what represents the essentials of our invention.

In a 1-step procedure for producing the grease compositions of our invention, there would be involved, for instance, broadly stated, preparing a single mixture of a highly overbased non-Newtonian calcium sulfonate solution in a mineral oil or the like then charging to this lime or calcium hydroxide, and a boric acid solution, soap-forming aliphatic monocarboxylic or fatty acid not used in the conversion step with or without supplemental ingredients, and thoroughly agitating the mixture. It will be understood that, in the 1-step procedure for producing the grease compositions of the present invention, for instance, where a mineral oil or like solution of a sulfonic acid or of a neutral calcium sulfonate is overbased and converted in essentially 1-step to produce a non-Newtonian overbased calcium sulfonate solution, which is further reacted with lime, boric acid and higher molecular weight monocarboxylic or fatty acid, e.g., 12-hydroxystearic acid, there is no intermediate isolation of overbased solution.

The preferred final high performance multipurpose calcium complex thixotropic grease or grease composition of this invention can be defined broadly as a product formed by a combination of (1) a highly overbased calcium sulfonate of a high molecular weight oil-soluble sulfonic acid, dissolved in an oil, particularly a mineral oil, containing extremely finely divided (at least mainly in excess of about 20 A, and, more particularly, in various particle sizes in the range of about 50 or about 100 up to about 1000 A, or even up to about 5,000 A,) calcium carbonate mainly or essentially in the form of calcite; (2) a product formed by the reaction of boric acid with a calcium compound such as, e.g., calcium hydroxide or calcium carbonate (as calcite), presumably calcium borate or calcium borate intermingled or in some kind of complex in the grease or grease composition as a whole; and (3) a product formed from calcium hydroxide/calcium carbonate (as calcite) and a soap-forming aliphatic monocarboxylic or fatty acid, particularly a soap-forming hydroxy-fatty acid, such as 12 hydroxystearic acid, wherein the calcite particles are formed in the presence of excess lime or a soap forming fatty acid.

As indicated above, cone penetration is determined by ASTM test (D217). More specifically, unworked penetration is measured when a sample of grease is brought to 77° F. (25° C.) and transferred to a standard cup; its surface is smoothed and the cone, in its penetrometer assembly placed so that its tip just touches the level grease surface. The cone and its movable assembly, weighing 150 G (0.33 pound), are permitted to rest on and drop into the grease for exactly five seconds. The distance dropped is measured.

Many greases change significantly in consistency when manipulated. A worked penetration is thus considered more significant as to service behavior than is unworked penetration. For this test, the grease is churned 60 round-trip strokes in a standard worker, again at 77° F. (25° C.). Air is driven out of the sample, its surface is smoothed, and again the penetration of the cores is measured.

CLASSIFICATION OF GREASES BY NLGI CONSISTENCY NUMBERS

| NLGI Number | ASTM Worked Penetration |
|---|---|
| 000 | 445–475 |
| 00 | 400–430 |
| 0 | 355–385 |
| 1 | 310–340 |
| 2 | 265–295 |
| 3 | 220–250 |
| 4 | 175–205 |
| 5 | 130–160 |
| 6 | 85–115 |

In the examples that follow, the starting overbased $C_{12}$ to $C_{40}$ alkylbenzene calcium sulfonate was prepared int he manner set forth in U.S. Pat. No. 4,560,489, which is incorporated by reference and analyzed as follows.

| | |
|---|---|
| Total Calcium, wt. % | 15.2 |
| Calcium $C_{12}$ to $C_{40}$ alkylbezene Sulfonate, wt. % | 18 |
| Alkalinity value (TBN) | 400 |
| Molecular weight | 1020 |
| Specific Gravity @ 60° F. | 1.200 |

-continued

| | |
|---|---|
| Flash Point C.O.C. °F. | 370 |
| Viscosity SUS @ 210° F. | 300 |
| Color ASTM Dilute | 7 |
| Water, et. % | 0.3 to 0.5 |
| Appearance | Bright |
| $CaCO_3$-(CALC), wt. % | 35 |
| Metal Ratio | 20 |

EXAMPLE 1

Three hundred eighty grams overbased calcium sulfonate (400TBN), 703 grams 500 SUS viscosity oil, 21.5 grams detergent dodecylbenzene sulfonic acid, 21.5 grams hydroxystearic acid and 38 grams water were mixed for 10 minutes in a pressure reactor. After addition of 4–5 grams acetic acid, the reactor was sealed and heated quickly to 250°–270° F. developing a pressure of 20 to 25 psi. After 1 hour at 250°–270° F. and 20 to 25 psi, thickening and conversion of amorphous calcium carbonate to calcite was complete as determined by infra-red and the reactor was vented and cooled to 200° F. using 250 grams 500 SUS viscosity oil. Eighteen and three-tenths grams additional 12-hydroxystearic acid was added and mixed for 15 minutes, followed by 29 grams lime in 50 grams water and 23 grams boric acid in 50 grams water. The composition was mixed at 280° F., adjusted to Grade 2 with about 200 grams 500 SUS viscosity oil, cooled to below 200° F. and 8.3 grams phenyl alpha naphthylamine added. The product weighing 1,660 grams, contained 22.9% starting overbased calcium sulfonate and had a worked penetration between 265–295.

COMPARISON EXAMPLE A

Example 1 was substantially repeated except that 31 grams hydroxystearic acid was present during the conversion of amorphous calcium carbonate to the crystalline form and no hydroxystearic acid was post added. The product weighing 1300 gram contained 29% starting overbased calcium sulfonate and a small amount of vaterite with the calcite.

COMPARISON EXAMPLE B

This example illustrates the production of a grease wherein all the hydroxystearic acid was present in the conversion of amorphous calcium carbonate to calcite and the process was not carried out under pressure. Three hundred eighty grams overbased calcium sulfonate, 73 gram 2000 SUS viscosity oil, 142 grams 500 SUS Viscosity oil, 21.5 grams detergent dodecylbenzene sulfonic acid, 31 grams 12-hydroxystearic acid and 38 grams water were heated to about 140°–145° F. under stirring in a two liter beaker. Four and one-half grams acetic acid was added slowly followed by 16.7 grams methanol. The reaction was maintained at 150° to 160° F. until thickening and conversion of amorphous calcium carbonate to calcite was complete as determined by infra-red. After 26.4 gram lime in 50 grams water and 23.2 grams boric acid in 50 grams water were added, volatiles were stripped off at 285° F., 4.6 grams of a mixture of phenyl alphanaphthyl amine added, cooled and adjusted to Grade 2 with about 200 grams Trim-500 viscosity oil. The product weighing 1180 grams, contained 32.2% starting overbased calcium sulfonate and had a worked penetration between 265 to 295.

Example 1 and comparison Example B demonstrate that higher yields of grease having substantially the same properties can be obtained using lower concentrations of overbased calcium sulfonate, when the process is carried out under pressure and long chain fatty acid is present in both the conversion of amorphous calcium carbonate to the calcite form and post added.

COMPARISON C

This example illustrates the preparation of a Grade 2 grease where all the hydroxystearic acid was added after the calcite forming step and the concentration of oleaginous material adjusted to produce a Grade 2 grease. Three hundred eighty-grams overbased calcium sulfonate, 73 grams 2000 viscosity oil, 21.5 grams detergent dodecylbenzene sulfonic acid and 38 grams water were heated to about 140°-145° F. under stirring in a one liter breaker. Four and one-half grams acetic acid was added slowly followed by 16.7 grams methanol. The reaction was maintained at 150° to 160° F. until thickening and conversion of amorphous calcium carbonate to calcite was complete as determined by infrared. After the composition was transferred to a 2-liter breaker, there was added in sequence 69 grams 2000 SUS viscosity oil, 73 grams 500 SUS viscosity oil, 26.4 grams lime in 50 grams water, 23 grams boric acid, and 31 grams 12-hydroxystearic acid. The reactants were stripped at 280° F., 4.6 grams of phenyl alpha naphthylamine added, cooled and adjusted to Grade 2 with about 250 grams 500 SUS viscosity oil. The product weighing 932 grams, contained about 40% starting overbased calcium sulfonate and had a worked penetration between 265 to 295.

EXAMPLE 2

This example illustrates the penetration grade of products prepared at 23% by weight and 28% by weight overbased calcium sulfonate. Example 1 was repeated except that the composition was adjusted with sufficient 500 SUS viscosity oil to give a 28% by weight overbased calcium sulfonate grease. The products of Comparison Examples A and C were each diluted with sufficient 500 SUS viscosity oil to provide 23% by weight and 28% by weight overbased calcium sulfonate greases. The worked cone penetration numbers are set forth below in Table I.

TABLE I

| Product of Example | 1 | 1 | A | A | C | C |
|---|---|---|---|---|---|---|
| | PEN | GRADE | PEN | GRADE | PEN | GRADE |
| % Overbased calcium Sulfonate | | | | | | |
| 28 | 220 | (3) | 312 | (1) | 355 | (0) |
| 23 | 270 | (2) | 357 | (0) | 385 | (0) |

The above data clearly shows that it is possible to produce Grade 2 and higher greases using less overbased calcium sulfonate by suitable process changes.

EXAMPLE 3

Example I was repeated, expect that the temperature was maintained below 200° F., thus no pressure was developed during thickening. The product weighed 1648 grams, and contained 23.0% overbased calcium sulfonate and had a worked penetration of 275.

While pressure was not utilized during the conversion step in example 3, pressure is preferred since a much shorter batch cycle time results when products are thickened at higher temperatures and pressures.

EXAMPLES 4 to 9

Example 1 was repeated except that the concentration of hydroxystearic acid was varied as set forth in Table II and the concentration of oleaginous material adjusted to produce a Grade 2 grease.

TABLE II

| Example | 4 | 5 | 6 | 7 | 8 | 9 |
|---|---|---|---|---|---|---|
| Grams 12 hydroxystearic acid during conversion | 19.9 | 27.1 | 27.1 | 31.8 | 27.1 | 39.8 |
| Grams 12 hydroxystearic acid post added | 19.9 | 12.7 | 22.7 | 17.9 | 32.6 | 0 |
| % by weight overbased calcium | 25.7 | 25 | 22.9 | 22.9 | 22.8 | 30 |
| Carbonate crystal form | Calcite | Calcite | Calcite | Calcite | Calcite | Calcite Vaterite |

EXAMPLE 10

This example illustrates the production of a Grade 2 grease containing about 23% by weight overbased calcium sulfonate using excess lime in the calcite forming step. After 535 grams overbased calcium sulfonate (400TBN), 400 grams 600 SUS viscosity oil, 50 grams of styrene-butadiene VI improver, 150 grams lime was heated to 150° F., 100 grams water and 85 grams dodecylbenzene sulfonic acid were added. The composition was heated to 180° to 190° F. while slowly adding 15 grams acetic acid followed by 495.5 grams of 600 SUS viscosity oil. After the reactants were maintained at about 190° to 200° F. for 2 hours, 175 grams 12-hydroxystearic acid and 5 grams water were added. The reactants were maintained at 190° to 205° F. until all of the 12-hydroxystearic acid dissolved. (A 10 gram sample of the product neutralized 20 ml. IN HC 1.) After heating to 330° F., 82.5 grams calcium borate was added and the temperature was maintained at 330° F. for 2 hours. Twelve and one-half grams p.p'-dioctyl diphenyl amine was added. The grease was adjusted to Grade 2 with 311 grams 500 SUS viscosity oil and 18 grams petroleum oil pour point depressant. The product weighing 2,329.5 grams, contained 23% starting overbased sulfonate and had a worked penetration of about 290 to 291.

EXAMPLE 11

Two Hundred and six grams overbased calcium sulfonate, 544 grams 500 SUS viscosity oil, 47 grams detergent dodecylbenzene sulfonic acid, 33 grams hydroxy stearic acid, 54 gms lime and 21 gms water were mixed for 10 minutes in a pressure reactor. After addition of 2.5 grams acetic acid, the reactor was sealed and heated quickly to 250°-270° F. developing a pressure of 20 to 25 psi. After 1 hour at 250°-270° F. and 20 to 25 psi thickening and conversion of amorphous calcium carbonate to calcite was complete as determined by infrared and the reactor was vented and cooled to 200° F. using 250 gms 500 sus viscosity oil. 20 gms of lime in 40 gms water was added and mixed for 15 minutes, followed by 15.5 gms boric acid in 40 gms water. The composition was mixed at 280° F., adjusted to Grade 2 with about 250 gms 500 SUS viscosity oil, cooled to below 200° F. and 8 gms phenyl alpha naphthyl-amine added. The product weighed 1430 gms, contained 14.4% starting overbased calcium sulfonate and had a worked penetration between 265–295.

We claim:

1. High performance overbased calcium sulfonate greases comprising up to about 28% by weight overbased calcium sulfonate, solid particles of colloidally dispersed calcium carbonate essentially in the form of calcite, a calcium soap of a fatty acid of twelve to twenty-four carbon atoms, and oleaginous vehicle wherein at a concentration of about 28% by weight overbased calcium sulfonate said greases have a worked cone penetration rating of less than about 295.

2. The composition of claim 1 wherein said fatty acid of twelve to twenty-four carbon atoms comprises hydroxystearic acid.

3. The composition of claim 1, wherein said grease contains a calcium borate or reaction product thereof.

4. The composition of claim 3, wherein said fatty acid of twelve to twenty-four carbon atoms comprises hydroxystearic acid.

5. The composition of claim 3 wherein said overbased calcium sulfonate comprises about 10 to 28% by weight of the grease.

6. The composition of claim 5 wherein said fatty acid comprises hydroxystearic acid.

7. The composition of claim 5 wherein said overbased calcium sulfonate comprises about 23% by weight of the grease.

8. The method of forming an overbased calcium sulfonate grease comprising an overbased calcium sulfonate, colloidally dispersed calcium carbonate in the form of calcite which comprises the steps of (1) heating a composition comprising overbased calcium sulfonate, amorphous calcium carbonate, an oleaginous vehicle, and a converting agent comprising a fatty acid of 12 to 24 carbon atoms and (2) adding to said composition with components comprising a fatty acid of 12 to 24 carbon atoms.

9. The process of claim 8 wherein said fatty acid comprises hydroxystearic acid.

10. The process of claim 8 wherein from 20 to 90% by weight of the fatty acid is employed in step 1.

11. The process of claim 8 wherein in step (2) said components also comprise a boric acid compound.

12. The process of claim 8, wherein step (1) is carried out under autogenous pressure.

13. The process of claim 12, wherein said fatty acid comprises hydroxystearic acid.

14. The process of claim 13 wherein from 50 to 75% by weight of the fatty acid is employed in step 1.

* * * * *